US008508110B2

(12) United States Patent
Suzuki et al.

(10) Patent No.: US 8,508,110 B2
(45) Date of Patent: Aug. 13, 2013

(54) MICRO CHANNEL PLATE

(75) Inventors: Akio Suzuki, Hamamatsu (JP); Etsuo Iizuka, Hamamatsu (JP); Toshiyuki Uchiyama, Hamamatsu (JP); Motohiro Suyama, Hamamatsu (JP)

(73) Assignee: Hamamatsu Photonics K.K., Hamamatsu-shi, Shizuoka (JP)

( * ) Notice: Subject to any disclaimer, the term of this patent is extended or adjusted under 35 U.S.C. 154(b) by 269 days.

(21) Appl. No.: 12/835,924

(22) Filed: Jul. 14, 2010

(65) Prior Publication Data

US 2011/0018419 A1 Jan. 27, 2011

(30) Foreign Application Priority Data

Jul. 21, 2009 (JP) ..... 2009-170375

(51) Int. Cl.
*H01J 43/04* (2006.01)
*H01J 43/06* (2006.01)

(52) U.S. Cl.
USPC ..... 313/103 CM; 313/105 CM; 250/207

(58) Field of Classification Search
USPC ... 313/103 CM, 103 R, 105 CM; 250/361 R, 250/207, 214 VT
See application file for complete search history.

(56) References Cited

U.S. PATENT DOCUMENTS

2007/0236118 A1* 10/2007 Laprade et al. ..... 313/103 R
2011/0155919 A1* 6/2011 Tokanai et al. ..... 250/385.1

FOREIGN PATENT DOCUMENTS

| | | |
|---|---|---|
| JP | S52-007668 | 1/1977 |
| JP | S62-176023 | 8/1987 |
| JP | 2005-243554 | 9/2005 |
| JP | 2007-059391 | 3/2007 |
| WO | WO 03/005408 | 1/2003 |
| WO | 2006/030820 | 3/2006 |
| WO | WO 2007013630 A1 * | 2/2007 |

* cited by examiner

*Primary Examiner* — Karabi Guharay
(74) *Attorney, Agent, or Firm* — Drinker Biddle & Reath LLP

(57) ABSTRACT

An MCP has a rectangular plate shape and has a porous part, to which a plurality of pores (channels) penetrating in the thickness direction are disposed, and a poreless part including a solid glass or the like to which the channels are not provided on the both sides of the porous part. Then, on both surfaces of the MCP, an input side electrode and an output side electrode are respectively formed so as to cover the poreless parts on the both surfaces while sandwiching the porous part.

6 Claims, 12 Drawing Sheets

(a)

(b)

MICRO CHANNEL PLATE

BACKGROUND OF THE INVENTION

1. Field of the Invention

The present invention relates to a micro channel plate for intensifying and outputting an electron, an ion, or the like and especially relates to a micro channel plate having a rectangular shape.

2. Related Background Art

There has been known a detection unit using a micro channel plate (MCP) for intensifying and outputting an incident electron or an ion so that a small amount of an electron, an ion, or the like can be accurately detected. There are two types of such an MCP: a round one and a rectangular one. WO 2006/030820 A1 discloses an example of a manufacturing method of such an MCP.

SUMMARY OF THE INVENTION

FIG. 9 shows an example of a rectangular MCP. An MCP 200 comprises a main body having only a porous part 10, which includes a plurality of pores called channels and electrodes 2 and 3 which are respectively disposed on both surfaces of a main body. FIG. 10 shows an example of a manufacturing method of such MCP 200. A large round-shaped MCP main body 210 including a poreless part 11, which is a solid glass and provided in the circumference of the porous part 10 is prepared. The MCP 200 is cut from the porous part 10 along the cutting lines L' and L" or the like.

A round-shaped main body 300 of the MCP generally includes the porous part 10 to which a plurality of pores called channels are provided and the poreless part 11 which is a poreless solid glass surrounding the porous part. As the main body of the rectangular MCP, other than the embodiment shown in FIG. 9, there is a case where a main body 400 is used in which the poreless parts 11 are formed on four peripheries of the porous part 10 as shown in FIG. 12 (*a*).

Although influence in the processing by thermal and stress loads on the porous part 10 and the poreless part 11 of the MCP differ, in the round-shaped MCP main body 300, deformation is suppressed in any direction because of the poreless part 11 surrounding the circumference. On the other hand, since the degree of deformation differs in each direction in the case of the rectangular MCP main body 400, distortion as shown in FIG. 12 (*b*) or warping as shown in FIGS. 12 (*c*) and (*d*) easily occurs and therefore it was difficult to manufacture a thin MCP having a minute channel.

Therefore, an object of the present invention is to provide a rectangular and thin MCP which has a minute channel and which can suppress deformation.

In order to solve the above-described problem, an MCP of the present invention is a rectangular MCP provided with a solid glass part on three or less sides of the external periphery of a plate main body and comprising film-shaped, plate-shaped, or stick-shaped input side and output side electrodes respectively disposed on an incident surface side and an exit surface side so that the electrodes are provided to cover the solid glass part.

It is preferable that the solid glass part is provided on two sides, especially two opposed sides. It is preferable that the plate main body is rectangular and that the solid glass part is disposed on a shorter side thereof. Moreover, it is preferable if a bias direction of each channel of the plate main body and an extending direction of a side wall to which the solid glass part is not disposed are matched with each other. It is preferable that surface area of a portion of each channel covered by the input side electrode is larger than that covered by the output side electrode.

The MCP of the present invention has a solid glass part on three or less side and is formed to allow a porous part to extend to the other side part. Thus, in a case where thermal or stress load is applied, the load is absorbed by channel deformation in the porous part so that deformation in the porous surface direction such as warping can be suppressed. Moreover, the electrode is provided so as to cover the solid glass part and a portion where the electrode covers the solid glass part becomes a voltage supply part. Thus, breakage failure of a channel by an external electrode for supplying voltage can be prevented and it becomes possible to supply voltage without causing breakage failure of a channel.

Providing the solid glass on two sides, especially on two opposed sides ensures strength and simultaneously allows easier handling thereof. Providing the solid glass on a shorter side effectively reduces distortion caused by generation of stress. If the bias direction and extending direction of a side wall are matched with each other, each channel can be efficiently utilized. Setting the output side electrode smaller stabilizes operation.

DESCRIPTION OF THE PREFERRED EMBODIMENTS

Figure 1:
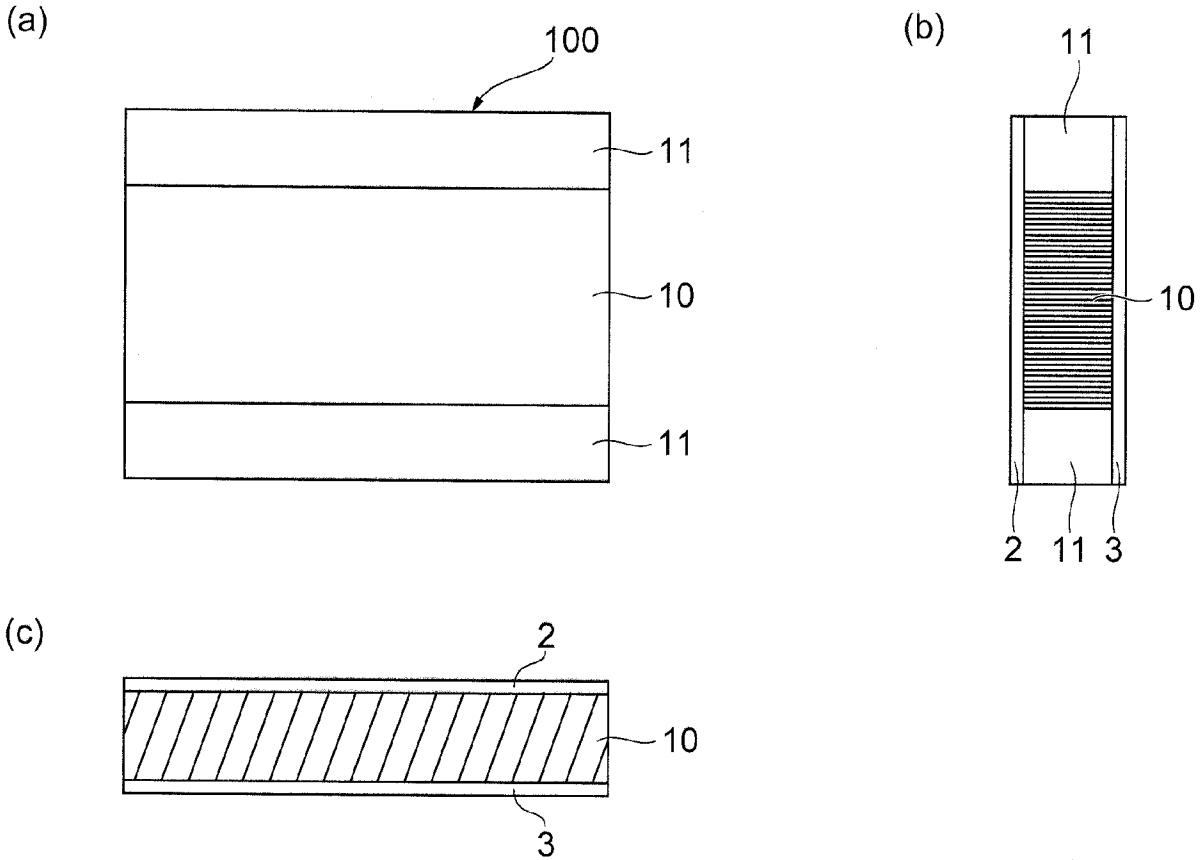
FIG. 1 is a view showing a first embodiment of a rectangular MCP of the present invention and FIG. 2 is a perspective view (imaginary view) of the main body part thereof.

Hereinafter, preferred embodiments of the present invention will be described in detail with reference to the accompanying drawings. To facilitate the comprehension of the explanation, the same reference numerals denote the same parts, where possible, throughout the drawings, and a repeated explanation will be omitted.

Figure 2:
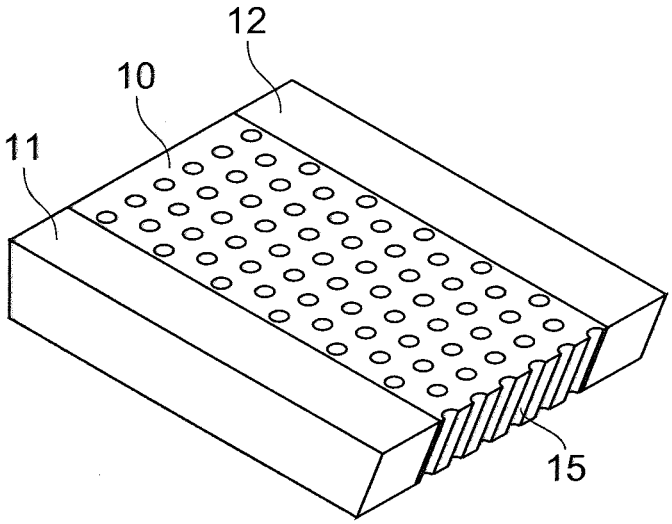

FIG. 1 (*a*) to FIG. 1 (*c*) indicate a first embodiment of a rectangular MCP of the present invention. FIG. 1 (*a*) is a front elevational view, FIG. 1 (*b*) and FIG. 1 (*c*) are a longitudinal-sectional view and a cross-sectional view. FIG. 2 is a perspective view of the main body part (imaginary view). The MCP 100 has a rectangular plate shape and has a plurality of pores (channels) 15 penetrating in the thickness direction of the MCP 100. Hereinafter, an area where the channel 15 is provided will be called a porous part 10. The channels 15 are parallel to each other and an axial direction thereof is inclined by a predetermined degree in a longitudinal direction of the MCP 100 toward a perpendicular vector of a surface of the MCP 100 (this angle is called a bias direction). Directions of hatching indicating the porous part 10 in FIGS. 1 (*b*) and (*c*) indicate axial directions of each of the channels 15 in a simulated manner. Poreless parts 11 are formed extending in the longitudinal direction of the MCP 100 so that the poreless parts 11 sandwich the porous part 10. The channel 15 is not formed in the poreless part 11 and the poreless part 11 is a solid glass. On the whole of both surfaces of the MCP 100, a film-shaped input side electrode 2 and an output side electrode 3 are formed by evaporation. That is, each of the electrodes 2 and 3 is formed to connect the poreless parts 11 which sandwich the porous part 10.

Figure 3:
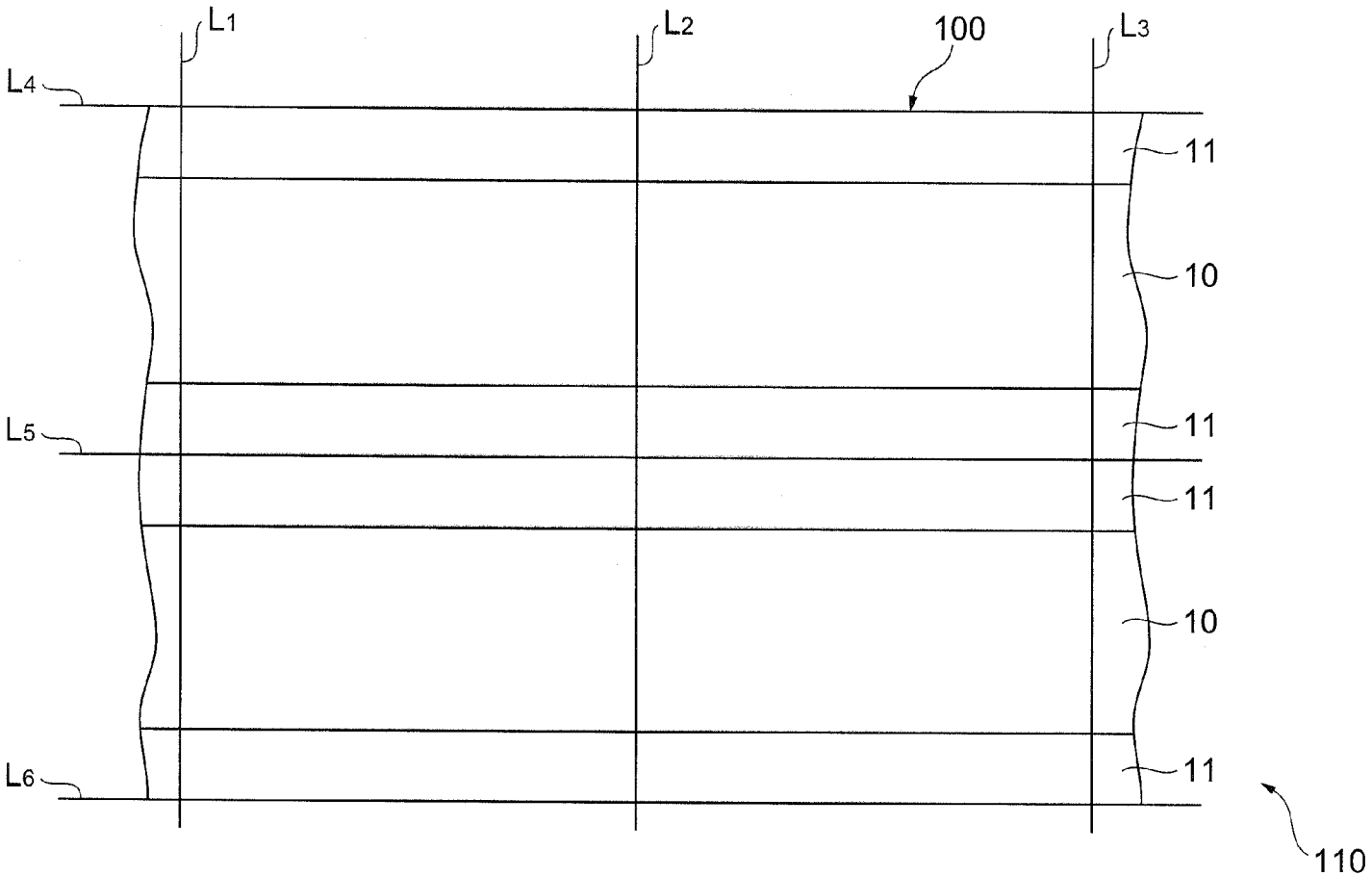
FIG. 3 is a view explaining manufacturing of the rectangular MCP of FIG. 1.

Next, a manufacturing method of the rectangular MCP will be explained. The rectangular MCP 100 is formed by cutting a plate, which includes the porous part 10 and a long and thin plate-shaped part corresponding to the poreless part 11 in an alternate manner and has both surfaces on which the input side electrode 2 and the output side electrode 3 are formed, along cutting lines $L_1$ to $L_6$, as shown in FIG. 3. For manufacturing the plate, a method disclosed in the above-described WO 2006/030820 A1 may be used.

In a case where a thermal or stress load is applied to the MCP 100 of the present embodiment, deformation in the periphery of the channel 15 in the porous part 10 absorbs the stress or the like so as to suppress deformation of the MCP 100 itself. Also in an MCP having only the porous part 10, such absorption of stress can be recognized. However, in the present embodiment, there are advantages that providing the poreless part 11 which is deformed little on both sides further suppresses deformation and that a stiffening effect is obtained when the MCP is totally downsized. This is effective for a thin MCP where minute channels are densely disposed.

Moreover, in the MCP having only the porous part 10, if the channel to which voltage is applied is damaged, there is a risk that a problem such as generation of noise occurs. However, in the present embodiment, voltage is applied to the poreless part 11 of the electrodes 2 and 3, therefore, generation of such a problem can be suppressed. In addition, using the poreless part 11 for physical fixation or connection such as connection with an external electrode prevents damage in the porous part 10 of the MCP 100.

Figure 4:
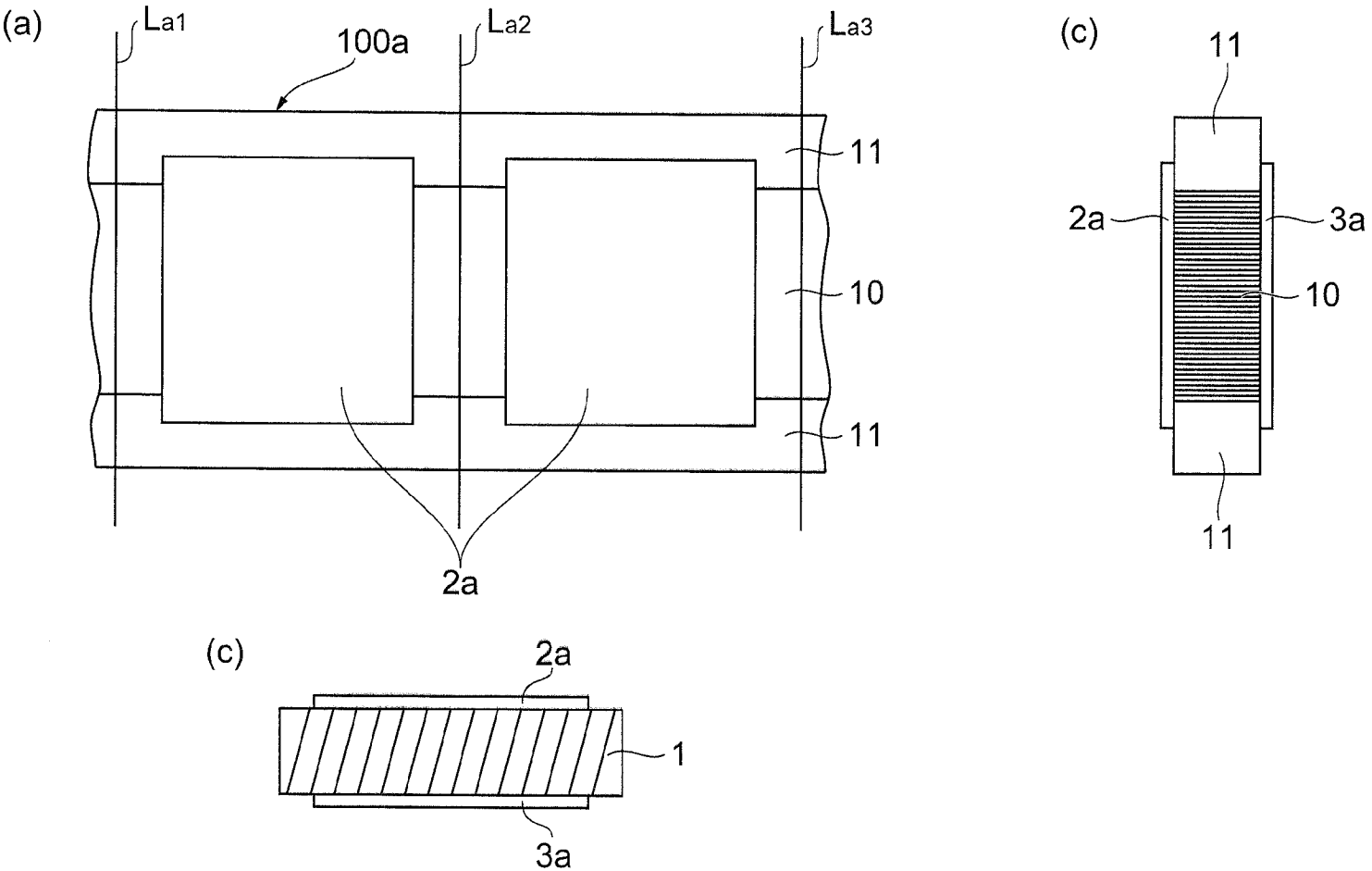
FIG. 4 to FIG. 8 are views respectively showing other embodiments of a rectangular MCP of the present invention.

The rectangular MCP of the present invention is not limited to the above-described embodiment. FIG. 4 (*a*) to FIG. 4 (*c*) show a second embodiment of the rectangular MCP of the present invention. The MCP 100*a* differs from the MCP 100 of the first embodiment in the following two points: Each of the electrodes 2 and 3 is not provided on the whole surface of the MCP 100*a* but is formed in an area which covers the poreless parts 11 on both sides and sandwiches the porous part 10 while external parts of the electrodes are exposed; and the poreless part 11 is not provided on a longer side but on a shorter side of the MCP. Thus, even when electrodes 2*a* and 3*a* are formed smaller than the surface area of the MCP 100*a* main body, an effect similar to that of the first embodiment can be obtained. Moreover, providing the poreless part 11 on the shorter side ensures width of the poreless part 11 itself in its extending direction, ensures strength, and enables easy handling.

Figure 5:
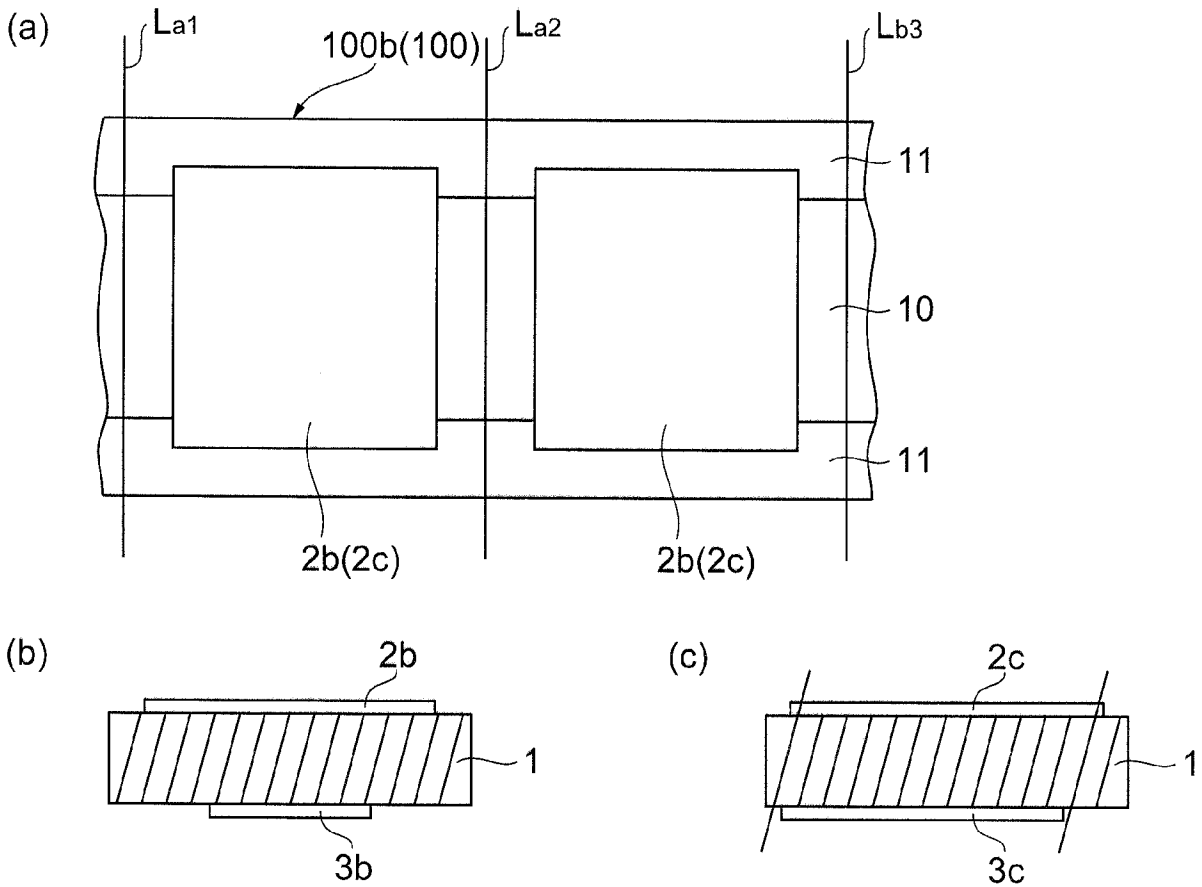

FIG. 5 (*a*) to FIG. 5 (*c*) are views showing a third embodiment of a rectangular MCP of the present invention. The MCP 100*b* and 100*c* have substantially the same configuration as that of the MCP 100*b* of the second embodiment. However, these are different in that output side electrodes 3*b* and 3*c* are formed smaller than input side electrodes 2*b* and 2*c*. Direction of hatching in the figure indicates the axial direction of the channel 15 in a simulated manner. At this time, when the input side electrodes 2*b* and 2*c* are formed to cover an area which includes all the inlets and is larger than an area covered by the output side electrodes 3*b* and 3*c* which cover the exit of the channel 15, an effect of stabilizing operation of the channel can be obtained.

Figure 6:
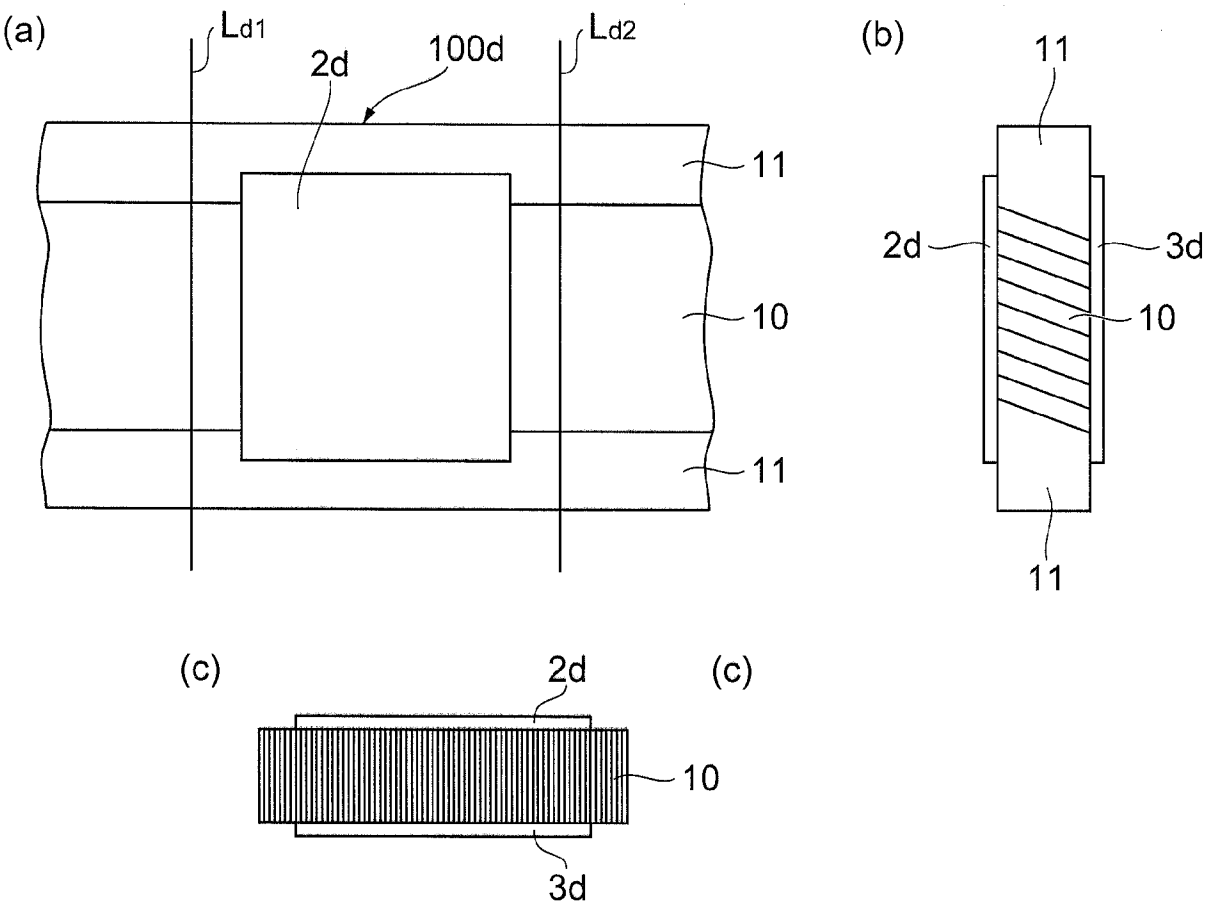

FIG. 6 (*a*) to FIG. 6 (*c*) are views showing a fourth embodiment of a rectangular MCP of the present invention. An MCP 100*d* of the fourth embodiment differs from the MCP 100*b* of the second embodiment in the extending direction of each of the channels 15. In this embodiment, the axial direction of the channel is matched with the direction which is matched with a cross-sectional surface formed by the cutting lines Ld1 and Ld2. As a result, the number of channels cut in the middle of the extending direction can be minimized and the ratio of effective channels in the porous part 10 can be maximized.

Figure 7:
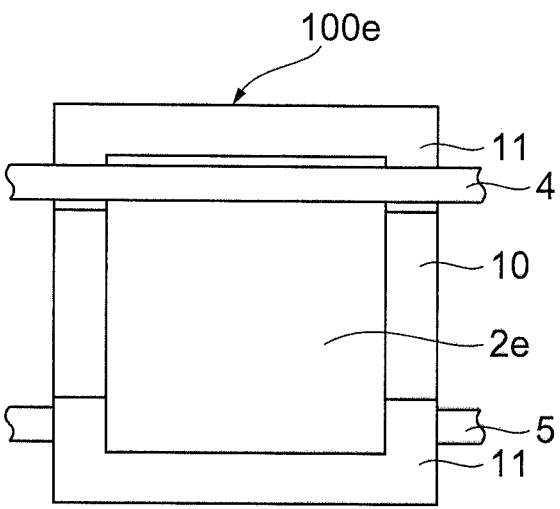
Figure 7:
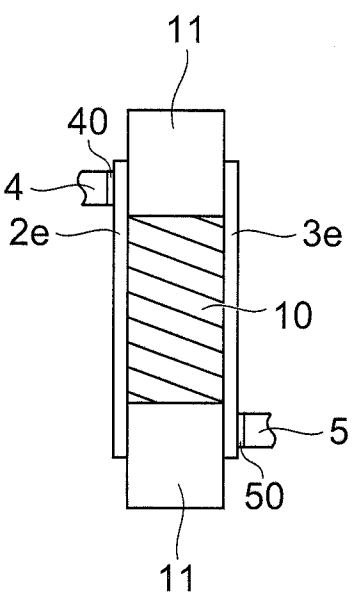

FIG. 7 (*a*) and FIG. 7(*b*) are views showing a fifth embodiment of a rectangular MCP of the present invention. In this embodiment, a difference is that stick-shaped electrodes 4 and 5 are attached to surfaces of portions on the poreless part 11 by conductive adhesive agents 40 and 50. According to this embodiment, application of voltage to the MCP 100*e* can be reliably conducted on the poreless part 11.

In the fifth embodiment, an example where a stick-shaped electrode is used as the electrode was explained. However, a configuration in which film-shaped or thin plate-shaped electrodes are attached on the surfaces of the MCP main body or a configuration in which other equipment is used to cause the electrodes to sandwich the MCP 100 may be adopted. In either case, it is preferable that the electrodes cover the poreless part 11 on the both sides.

Figure 8:
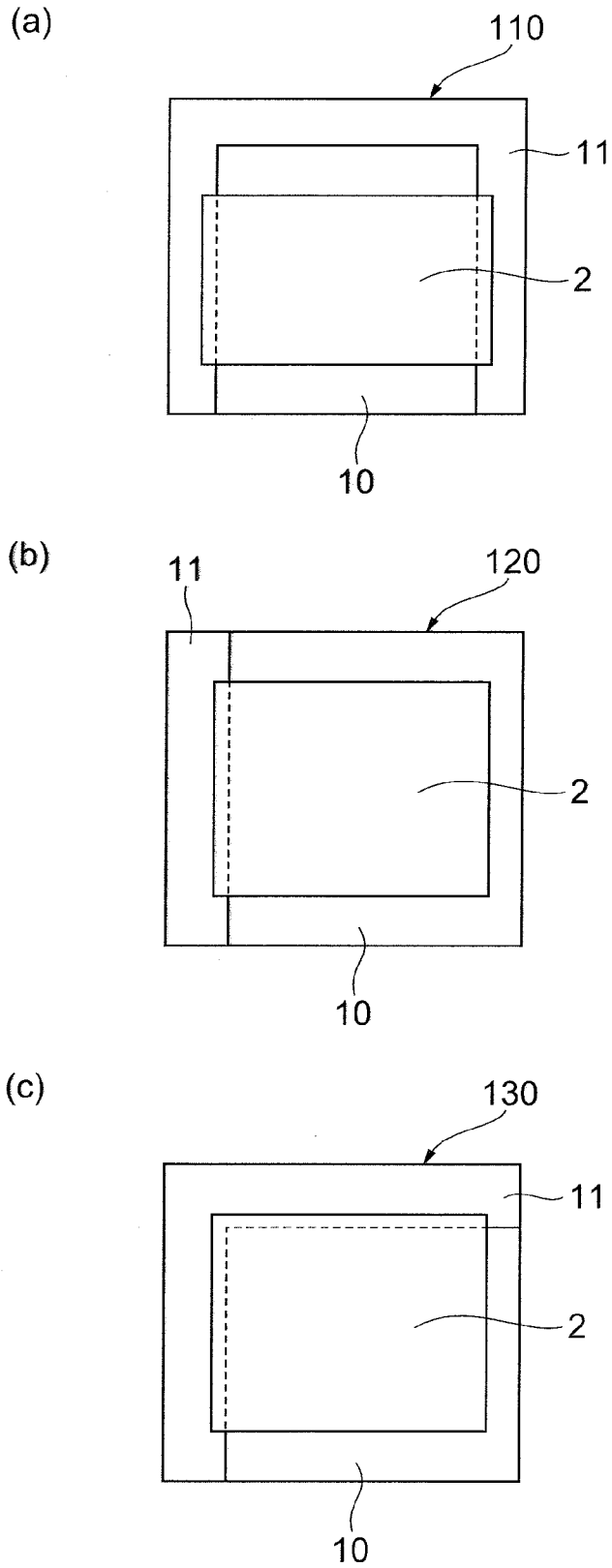
Figure 9:
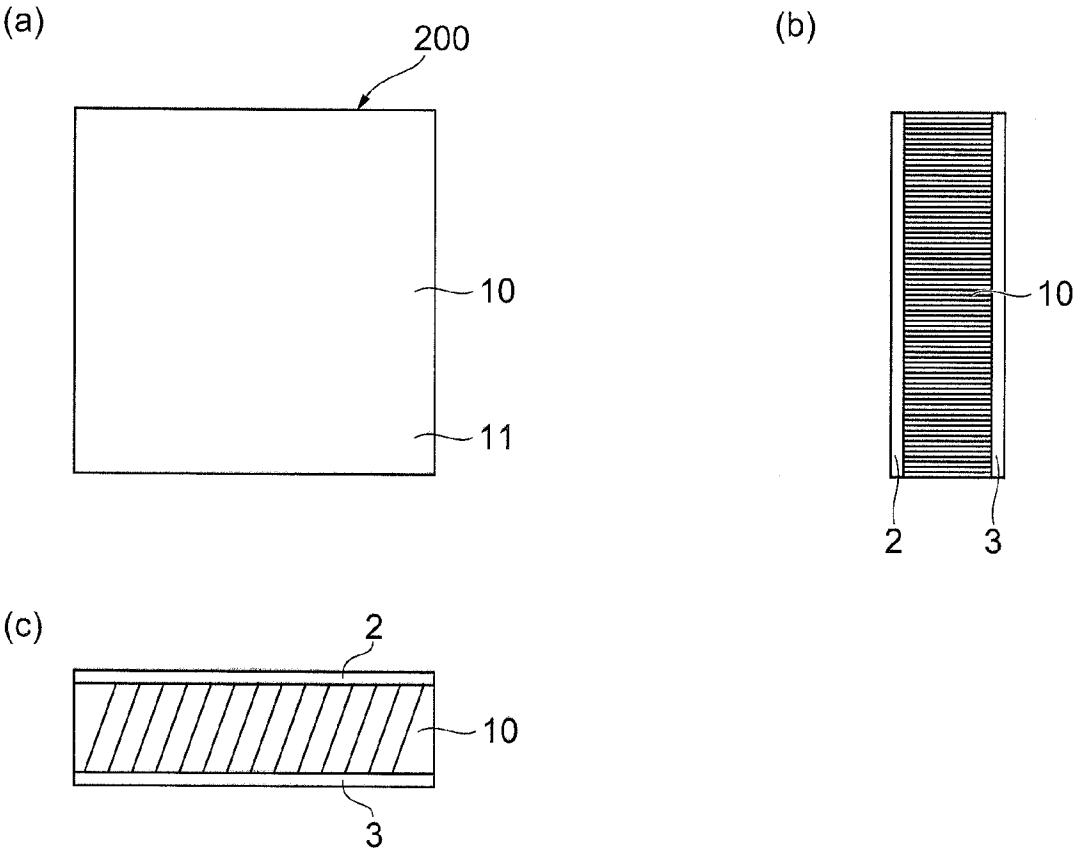
FIG. 9 is a view showing a configuration example of a conventional rectangular MCP and FIG. 10 is a view explaining a manufacturing method thereof.
Figure 10:
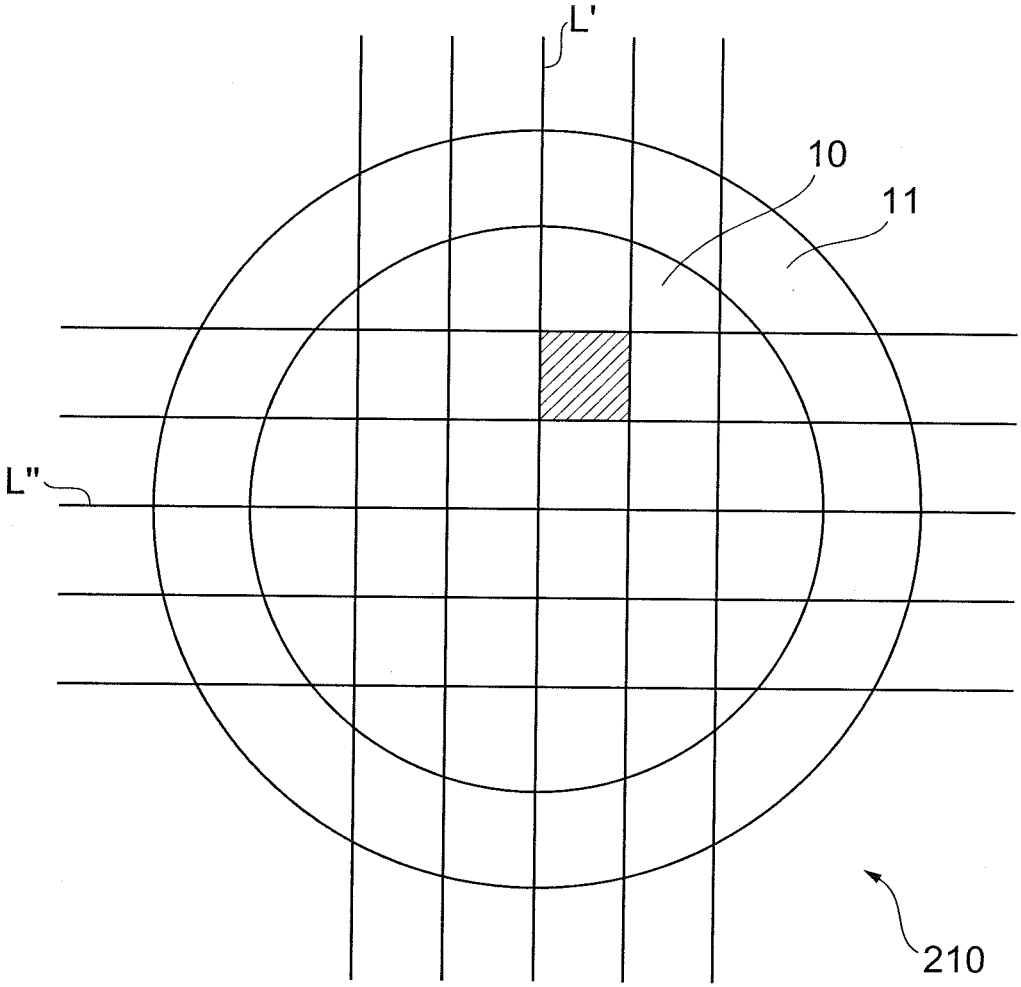
Figure 11:
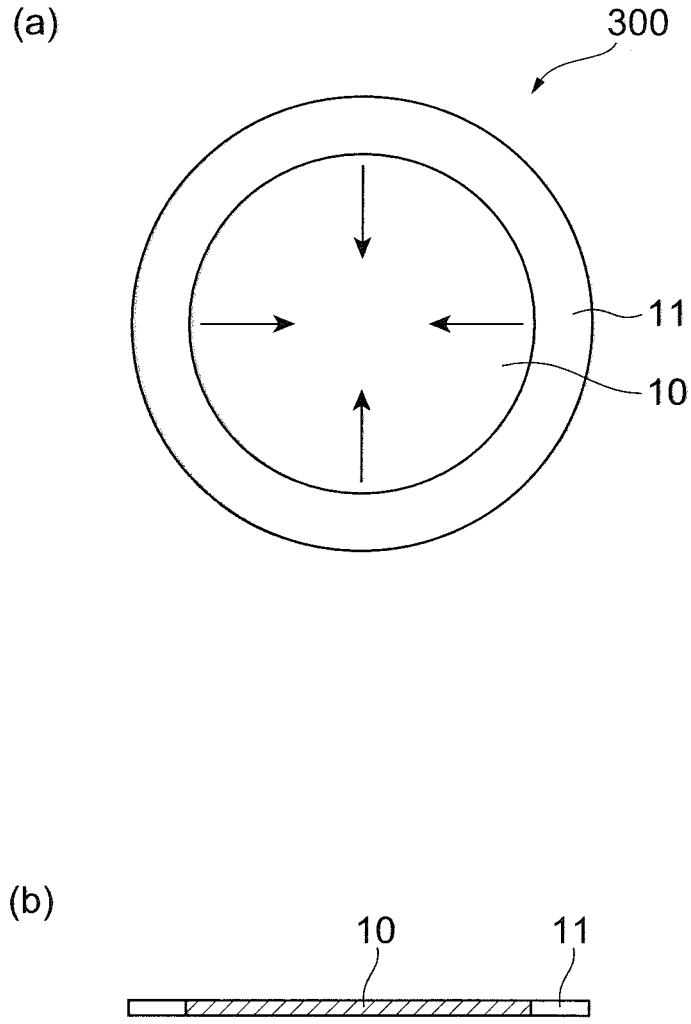
FIGS. 11 and 12 are views explaining a structure and deformation of a conventional round-shaped MCP.
Figure 12:
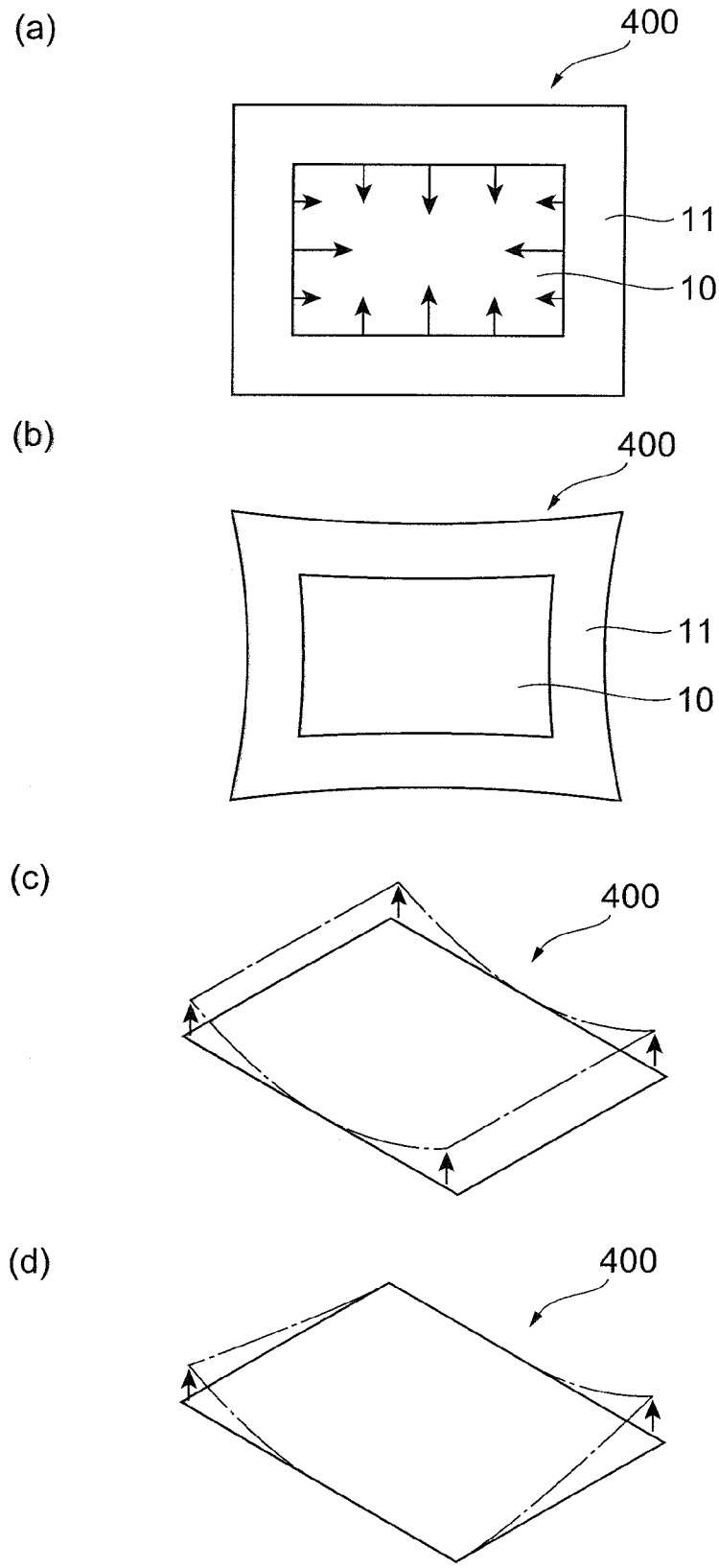

The rectangular MCP of the present invention is not limited to the embodiments by which solid glass parts are provided on two sides opposed to each other, as described above. As shown in the MCP 110 in FIG. 8 (*a*), the solid glass part 11 may be disposed on three sides surrounding the porous part 10 or as shown in the MCP 120 in FIG. 8 (*b*), the solid glass part 11 may be disposed only on one side which is adjacent to the porous part 10. Moreover, even in a case where the solid glass part 11 is disposed on two sides, as shown in MCP 130 in FIG. 8 (*c*), the solid glass part 11 may be provided on two adjacent sides. Although these embodiments are inferior to the above-described embodiments 1 to 5, in which the solid glass part is provided on two opposed sides, in terms of strength or ease in handling, an effect of suppressing deformation can be obtained more than the conventional example, similar to the above-described embodiments.

What is claimed is:

1. A rectangular micro channel plate provided with a solid glass poreless part on three or less sides of the external periphery of a plate main body and comprising film-shaped, and a stick or plate-shaped input side and output side electrodes respectively disposed on an incident surface side and an exit surface side so that the electrodes are provided to cover the solid glass part, wherein both the micro channel plate and the solid glass poreless part have a rectangular shape, a pair of poreless parts sandwiches the micro channel plate, both the input side electrode and the output electrode cover an effective area of the micro channel plate and its adjacent area of the solid glass poreless part, the stick or plate shaped input electrode is attached to surfaces of portions on the film-shaped input electrode on the portions of the one of the poreless part by conductive adhesive agents, and the stick or plate shaped output electrodes are attached to surfaces on the film-shaped electrodes on the portions of other one of the poreless part by conductive adhesive agents, and the axial direction of each channel of the micro channel plate is matched with a direction which is matched with a cross-sectional surface formed by cutting lines.

2. The micro channel plate according to claim 1, wherein the solid glass poreless parts are provided on at least two sides.

3. The micro channel plate according to claim 2, wherein the two sides having the solid glass poreless parts oppose each other.

4. The micro channel plate according to claim 3, wherein the plate main body is rectangular and the solid glass poreless parts are disposed on the shorter sides thereof.

5. The micro channel plate according to claim 1, wherein a bias direction of each channel of the plate main body and extending direction of one side wall to which the solid glass poreless part is not disposed are matched with each other.

6. The micro channel plate according to claim 1, wherein an area of a channel on the input side electrode side covered by the electrode is larger than an area of a channel on the output side electrode side covered by the electrode.

* * * * *